US007998551B2

(12) United States Patent
Gasser

(10) Patent No.: US 7,998,551 B2
(45) Date of Patent: Aug. 16, 2011

(54) UNITARY MOLDED, SHAPED AND SIZED PROTECTIVE EDGE MADE OF ELASTOMERIC MATERIAL

(75) Inventor: Mark E. Gasser, Hubbard, OH (US)

(73) Assignee: Gasser Chair Company, Inc., Youngstown, OH (US)

( * ) Notice: Subject to any disclaimer, the term of this patent is extended or adjusted under 35 U.S.C. 154(b) by 346 days.

(21) Appl. No.: 12/006,811

(22) Filed: Jan. 3, 2008

(65) Prior Publication Data

US 2008/0166515 A1 Jul. 10, 2008

Related U.S. Application Data

(60) Provisional application No. 60/878,893, filed on Jan. 5, 2007.

(51) Int. Cl.
*B32B 3/06* (2006.01)

(52) U.S. Cl. ..... 428/122; 297/183.7

(58) Field of Classification Search ..... 428/99, 428/122; 248/345.1; 108/27; 297/183.7, 297/183.6, 183.1, 183.5
See application file for complete search history.

(56) References Cited

U.S. PATENT DOCUMENTS

| | | | |
|---|---|---|---|
| 1,936,113 | A | 11/1933 | Jelliffe |
| 2,121,826 | A | 6/1938 | Roberts |
| 2,547,239 | A | 4/1951 | Walker |
| 2,564,386 | A | 8/1951 | Webb |
| 2,673,600 | A | 3/1954 | Cramer |
| 3,647,260 | A | 3/1972 | Grant et al. |
| 3,831,990 | A | 8/1974 | Singh et al. |
| 3,836,043 | A | 9/1974 | Levin |
| 4,003,180 | A | 1/1977 | Messuri |
| 4,012,878 | A | 3/1977 | Ellingson |
| 4,106,739 | A | 8/1978 | Gasser |
| 4,153,230 | A | 5/1979 | Giacin |
| 4,503,780 | A | 3/1985 | Apissomian |
| 4,558,553 | A | 12/1985 | Kolk |
| 5,118,162 | A | 6/1992 | Saul |
| 5,248,186 | A | 9/1993 | Steinfeld et al. |
| 5,271,662 | A | 12/1993 | Saul |
| 5,527,097 | A | 6/1996 | Martin |
| D413,216 | S | 8/1999 | Regan et al. |
| D413,743 | S | 9/1999 | Regan et al. |
| 6,354,400 | B1 | 3/2002 | Purkayastha |
| 6,378,831 | B1 | 4/2002 | Copeland, Jr. |
| D463,261 | S | 9/2002 | Ursini et al. |
| 6,564,409 | B2 | 5/2003 | Metz et al. |
| 6,708,941 | B1 | 3/2004 | Bowen et al. |
| 2005/0242648 | A1 | 11/2005 | Williams et al. |

*Primary Examiner* — Alexander Thomas
(74) *Attorney, Agent, or Firm* — Lerner, David, Littenberg, Krumholz & Mentlik, LLP

(57) ABSTRACT

An elastomeric plastic material is molded by known methods to provide a formed, sized, shaped and self-contained, generally unitary, protective member for correspondingly shaped and sized unfinished, raw and the like edge of furniture or other devices which require protection or coverage, such that the protective member, because of its elastomeric characteristics, can be fitted or snapped into assembled position about such unprotected or unfinished edge and then easily fixed into assembled position, by conventional stapling using associated spaced flanges thereon, saving costs of material and labor. In the molding, additional modifications can be added such as a hand grip to facilitate movement of the furniture. The plastic protective member can be molded with a central cavity having an opening into which colored and non-colored fillers and/or braided rope can be inserted.

5 Claims, 4 Drawing Sheets

UNITARY MOLDED, SHAPED AND SIZED PROTECTIVE EDGE MADE OF ELASTOMERIC MATERIAL

CROSS-REFERENCE TO RELATED APPLICATIONS

This application claims the benefit of the filing date of U.S. Provisional Patent Application No. 60/878,893 filed Jan. 5, 2007, the disclosure of which is hereby incorporated herein by reference.

BACKGROUND OF THE INVENTION

This invention relates to plastic protective edges for chairs, furniture and other devices that require protection against damage to their sides and edges, and more particularly to unitary, molded, formed, sized and shaped self-contained protective members made of an elastomeric plastic material that can be fitted, snapped and affixed by suitable and relatively simple means and a minimal amount of labor into assembled position over the unprotected or unfinished edge of the correspondingly shaped device such, for example, as the back of a chair. This effectively reduces the cost of manufacturing and finishing the chair or other device on which this improved plastic protective edge is used so that it is more competitive in the commercial marketplace. In addition, the conventional molding process for making such improved protective edge enables additional modifications to be added and enables the formed structure to achieve all the decorating and aesthetic advantages of the prior art protective edge devices.

BACKGROUND OF THE INVENTION

It is a well known expedient in the prior art to make elongated extruded plastic members which are applied to and affixed to the backs and the edge portions of casino chairs, other pieces of furniture and other devices, as is shown and illustrated by the early U.S. Pat. No. 4,106,739 and U.S. Pat. Nos. 5,527,097; 5,118,162; 5,248,186; 2,121,826 and others. These extruded plastic protective devices usually used for the backs of chairs of various types and other furniture and devices have means for enabling them to be affixed in assembled position such as the spaced side flanges as at 11 and 12 in U.S. Pat. No. 4,106,739. These spaced side flanges require the application of skilled labor for affixing the plastic protective edges into assembled position correctly and accordingly this adds material labor to the manufacturing costs for a given chair, piece of furniture or other device using such protective edge devices.

It is also known in the prior art that a single protective edge can be formed from a plurality of extruded sections of the elastomeric material so that they can be fitted and connected about the portion of the device which requires protection for various reasons, for example, as shown in U.S. Pat. No. 6,378,831 B1.

Still further, safety bumpers are known in the prior art so formed that they can be fitted and snapped into assembled position around the edge portion of the device for various purposes as is shown in U.S. Pat. No. 4,153,230.

SUMMARY AND OBJECTS OF THE DISCLOSURE

The present invention utilizes a unitary molded, formed, sized and shaped plastic member made of an elastomeric material such that it can be easily fitted and snapped into assembled position about the unprotected or unfinished edge of the back of a chair or a piece of furniture or other device and then easily affixed into assembled position, for example, by simple stapling or other affixing methods so as to reduce the overall manufacturing costs for the chair, furniture or other device on which it is being used.

Further, the manufacture of this type of plastic protective member allows for advantageous features to be easily added to the molded protective member, such as a hand hold at the upper edge that facilitates moving the chair, furniture or other device on which it will be assembled and affixed.

Thus, it is another aspect of the present disclosure to provide a unitary, molded, formed, shaped and sized plastic protective member made of an elastomeric material which is easy to assemble on the correspondingly shaped edge, part or section of the device to be protected and simpler to affix so that the cost of manufacture of the device is reduced.

It is another aspect of the present disclosure to provide a unitary, molded, shaped and sized plastic protective member made of an elastomeric material adapted to fit so that it can be easily affixed into assembled position about the edge of the device that requires protection.

It is a still further aspect of the present disclosure to provide a unitary, molded, shaped and sized plastic protective member made of an elastomeric material on which additional structures can be easily added during the molding and formation such as a hand hold section at the upper end of the protective member for facilitating movement of the device on which it is assembled and affixed.

It is a still further aspect of the present disclosure to provide a unitary, molded, shaped and sized plastic protective member made of an elastomeric material that can expand to be fitted and snapped into assembled position about an edge, part or section of a device to be protected and will not become dislodged and which can be adapted to simplify the affixing of the protective member into assembled position.

It is a still further aspect of the present disclosure to provide a unitary, molded, shaped and sized plastic protective member made of an elastomeric material that can expand to be fitted and snapped into assembled position about an edge or portion of a device to be protected and will not become dislodged and which can be adapted to simplify the affixing of this protective member into assembled position and can achieve the same decorative modifications; for example, inserting braided rope or other materials to enhance the appearance of the overall product when it is in assembled position.

Other objects and advantages will become apparent and will be more fully understood by those skilled in the art from the description which follows below, taken with reference to the accompanying drawings in which:

DESCRIPTION OF A PREFERRED EMBODIMENT

While the figures of the drawings show an improved plastic protective edge for a correspondingly shaped back of a chair, those skilled in the art will recognize that this is only for purposes of illustrating how the improved plastic protective edge is formed and established in accordance with the present disclosure and not by way of limitation.

Thus, the figures of the drawings show one form of the improved plastic protective edge in accordance with the present disclosure generally designated 10 which has been molded in the shape to fit about the unfinished edge of the back of certain types of well known chairs which have been sold for over fifty years in the commercial marketplace by Gasser Chair Company, Inc.

In order to establish the shape, conventional molding apparatus may be used which consists of a coacting base unit and a cover unit, not shown, but well known in the art. The desired shape is so formed in these respective coacting members of the molding unit that when the cover unit is closed, an opening in communication with the formed shape in the coacting members of the molding unit is provided to permit the selected plastic in its liquid form to be charged into the formed shape in the molding unit, a method or process also well known in the art. The plastic is then treated with suitable heating means in the coacting members of the molding unit so that when the cover unit is opened, the shaped and sized plastic protective edge is fully formed. This formed unit is then permitted to cure by cooling, and when removed from the molding apparatus, it can be applied about the unfinished or unprotected edge of the back of the chair as hereinafter described. This type of molding apparatus and the coacting members are well known in the molding art and therefore will not be more fully described because apparatus and molding techniques are well known to those skilled in the art.

The plastic materials which are used to mold and form the shaped and sized plastic protective edge must be elastomeric so that the advantages of this type of plastic protective edge can be obtained. Thus, it has been found that plastic materials having a polyvinylchloride composition or combinations of vulcanized rubber compositions and plastic materials not only enable the plastic protective edge to the stretched but in addition allow for one given form of the plastic protective edge to be used for a plurality of sizes of correspondingly shaped backs on chairs of the same type.

Figure 1:
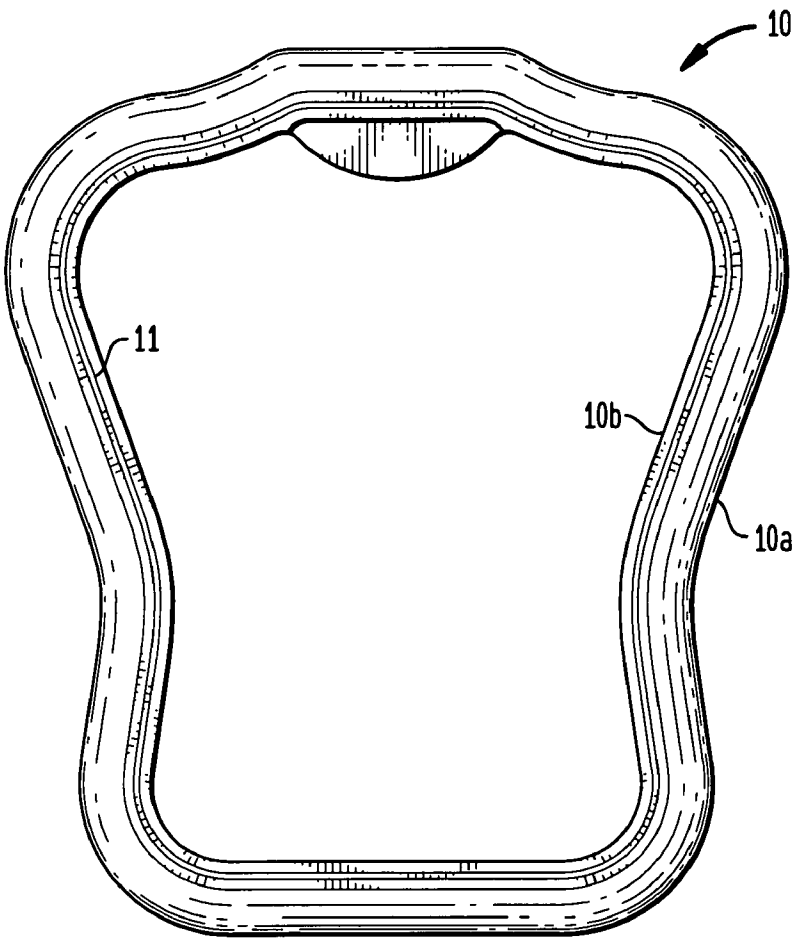
FIG. 1 is a front view of one type of unitary molded, formed, shaped and sized plastic protective member in accordance with the present disclosure.
Figure 2:
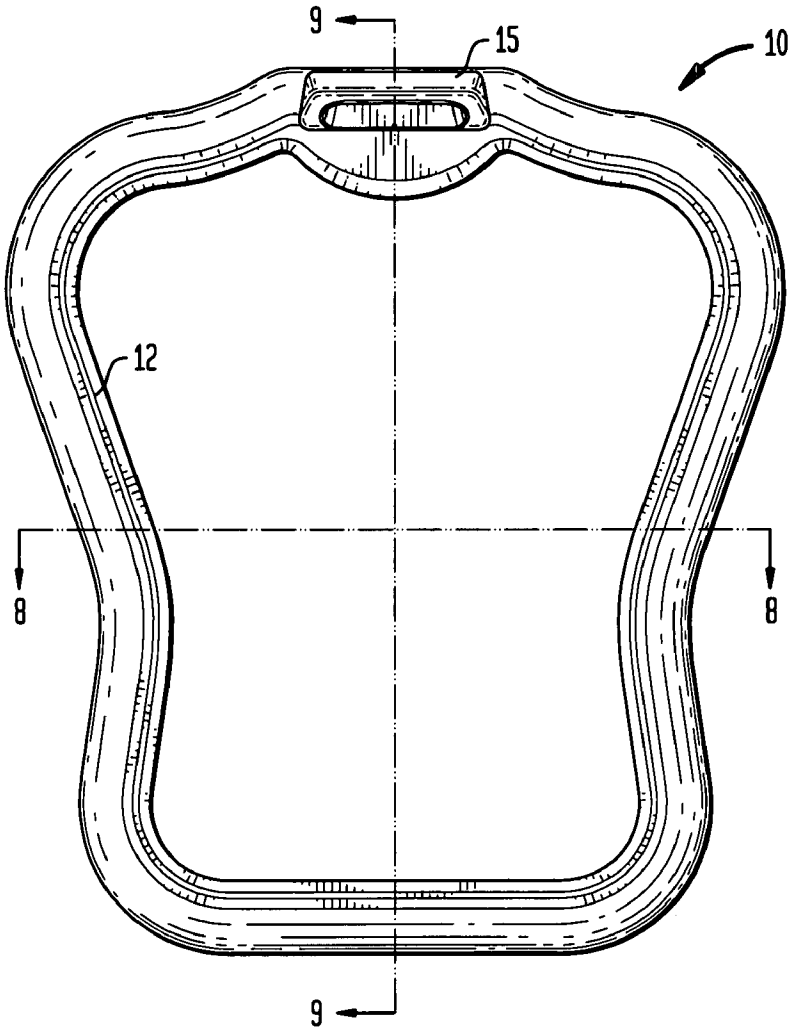
FIG. 2 is a back view of the unitary molded, formed, shaped and sized plastic protective member shown in FIG. 1.
Figure 3:
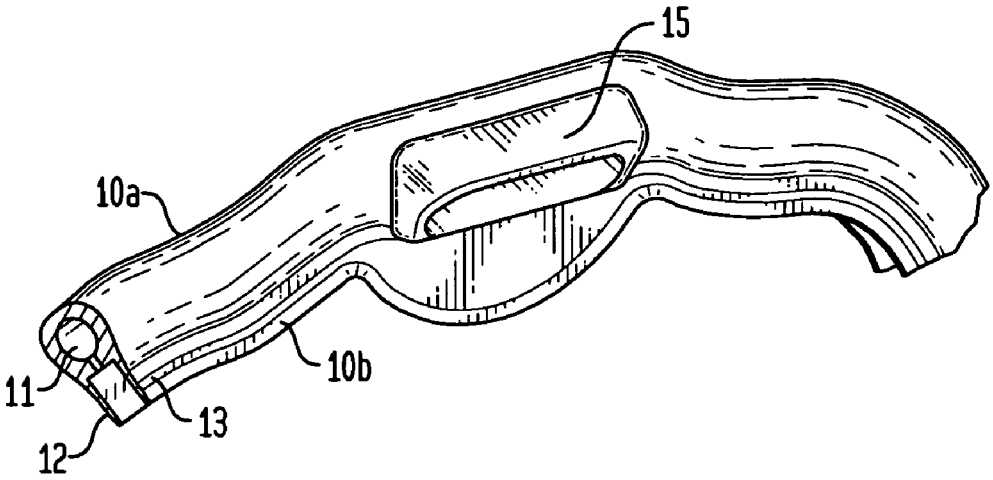
FIG. 3 is an enlarged back perspective view of an upper fragment of the unitary, molded, formed, shaped and sized plastic protective member shown in FIG. 2 showing a hand grip addition molded into the protective member.
Figure 4:
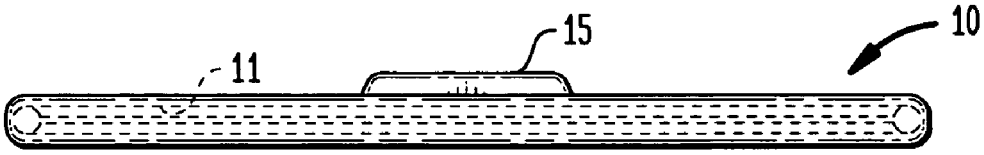
FIG. 4 is a top plan view of the plastic protective member shown in FIG. 1.
Figure 5:
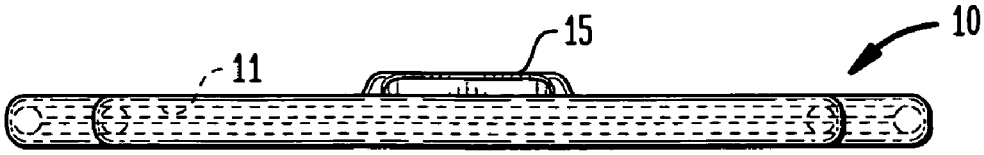
FIG. 5 is a bottom plan view of the plastic protective member shown in FIG. 1.
Figure 6:
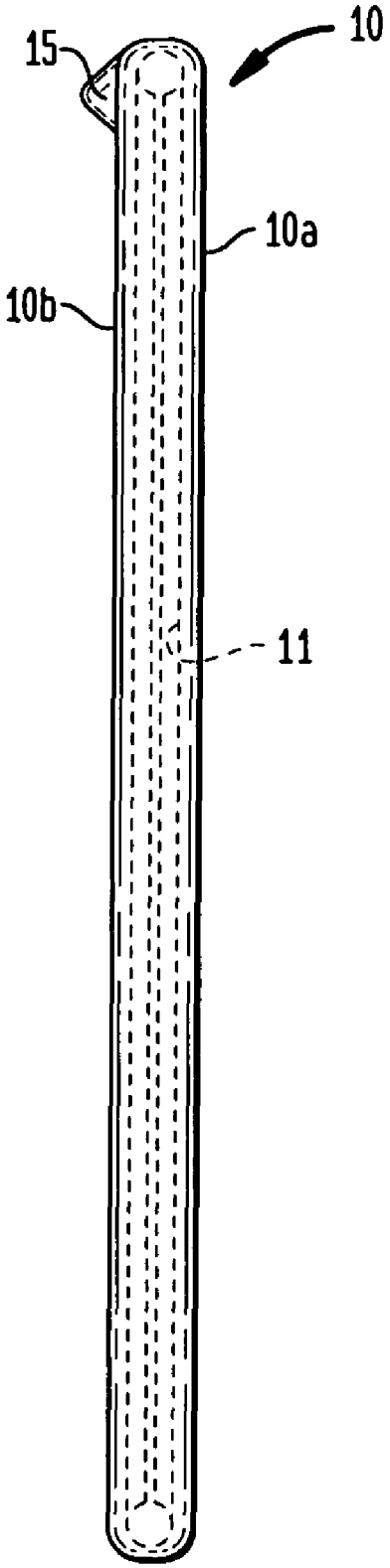
FIG. 6 is a right side view of the plastic protective member shown in FIG. 1.
Figure 7:
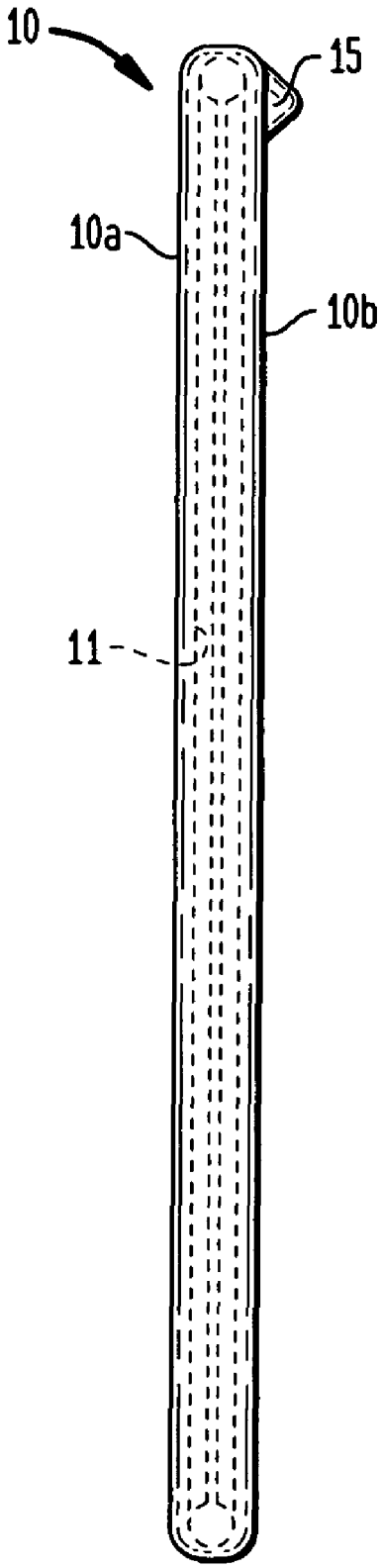
FIG. 7 is a left side view of the plastic protective member shown in FIG. 1.
Figure 8:
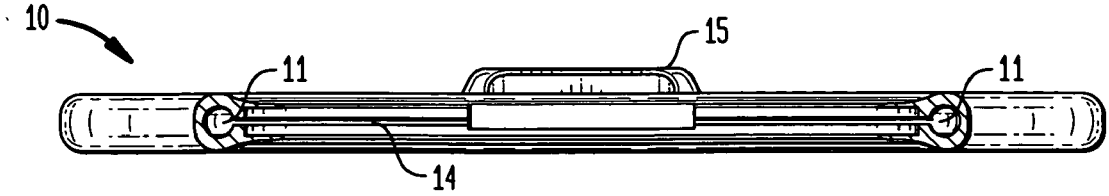
FIG. 8 is a cross-section taken on line 8-8 of FIG. 2.
Figure 9:
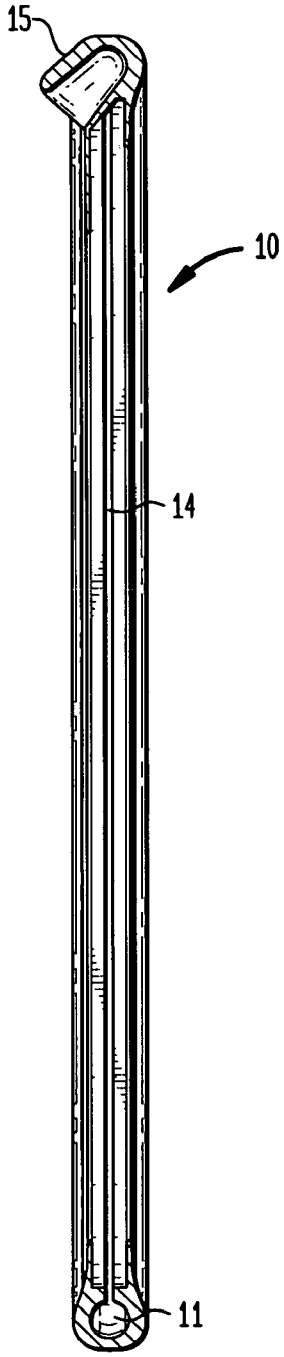
FIG. 9 is a cross-section taken on line 9-9 of FIG. 2.
Figure 10:
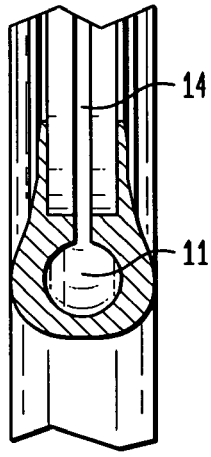
FIG. 10 is an enlarged fragment of the cross-section at FIG. 8 showing the central opening formed at the inner aspect of the plastic protective member.
Figure 11:
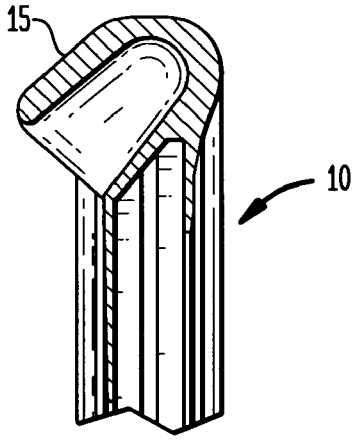
FIG. 11 is an enlarged fragment of the cross-section at FIG. 9 showing the formed hand grip.

As shown at FIGS. 1 and 2 of the drawings, outer periphery 10*a* and inner periphery 10*b*, the plastic protective edge 10 has the distinctive shape of the correspondingly shaped back of the chair, not shown, onto which the plastic protective edge will be fitted.

When molded and formed, the plastic protective edge is a generally rounded member having a hollow shaped center section 11 and a pair of spaced flanges as at 12 and 13 which extend inwardly from the inner periphery 10*b* of the plastic protective edge 10.

The hollow shaped center section 11 of the generally round portion of the plastic protective edge 10 communicates at its inner section with an opening 14. If the plastic protective edge is made of a transparent or translucent material, the opening 14 permits and allows a rope or other threaded or braided member, not shown, to be inserted into the hollow shaped center section 11 of the plastic protective edge when it is desired to enhance the appearance of the plastic protective edge 10 when it is in assembled and attached to the unfinished or raw edge of the correspondingly shaped chair.

As is also shown by the drawings, the mechanism for molding and forming the plastic protective edge 10 also allows for the addition of improvements such as the hand grip 15 which can be incorporated into the design of the mold and formed at the back and upper outer edge of the generally rounded section of the plastic protective edge, all of which is shown by FIGS. 3, 4, 5, 6, 7, 8, 9 and 11 of the drawings.

By reason of the materials from which the plastic protective edge 10 is formed, it will have a limited degree of expandability. This enables the plastic protective edge to be snapped into assembled position about the unfinished or raw peripheral edge of the correspondingly shaped back of the chair, not shown, for which it has been designed.

Once the plastic protective edge 10 is in assembled position, it can be fastened by conventional stapling into assembled position on the front and rear face of the back of the chair, not shown.

Thus, the present disclosure provides a plastic protective edge for the unfinished or raw edge or perimeter of a chair so as to guard against damage, provide an appealing decor to the chair, the same soft surface contact and advantages as the prior art devices. When formed of the preferred materials as specified herein, it simplifies the affixing of the plastic protective edge into assembled position and enables additional structure and changes to be incorporated into this advantageous device for chairs, furniture and other applications.

Although only one embodiment of the present disclosure has been illustrated and described, it will be apparent to those skilled in the art that various changes and modifications may be made without departing from the spirit of this disclosure.

The invention claimed is:

1. A plastic protective edge for furniture and other devices having structural portions defining an unfinished peripheral edge comprising:

a. molded and formed unitary member made of elastomeric plastic compositions sized to fit about and protect the peripheral edge of the structural portions of furniture and other devices when snapped and fitted into assembled position, b. said molded member having a rounded and shaped body portion to form a first cushioning means for the peripheral edge and defining a storage space in and along the rounded body portion, and an opening which communicates with the storage space, c. a pair of flanges disposed in predetermined spaced relation extending from an inner section of said rounded body portion to enable the molded and formed unitary plastic protective edge to be affixed after it is snapped and fitted into assembled position on said peripheral edge, whereby the inner side of said rounded body portion and the peripheral edge of the structural portion of the furniture and other device define a second cushioning means therebetween and d. an integrated handgrip molded and formed as part of the unitary member and at least partially inset into the unitary member.

2. In the plastic protective edge for the peripheral edge of the structural portion of furniture and other devices as in claim 1 wherein the elastomeric plastic composition consists of at least polyvinylchloride.

3. In the plastic protective edge for the peripheral edge of the structural portion of furniture and other devices as in claim 1 wherein the elastomeric plastic composition consists of at least polyvinylchloride and vulcanized rubber.

4. In the plastic protective edge for the peripheral edge of the structural portions of furniture and other devices as in claim 1, 2 or 3, wherein the opening in communication with said storage space provides an access opening for optionally and selectively inserting colored and non-colored fillers such as decorative rope and fabric.

5. In the plastic protective edge for the peripheral edge of the structural portions of furniture and other devices as in claim 1, 2 or 3, including the opening in communication with said storage space which provides an access opening for optionally and selectively inserting colored and non-colored fillers such as decorative rope and fabric, and means on the outer section of the rounded and shaped body portion forming a hand grip.

* * * * *